United States Patent [19]

Kuhtreiber

[11] 3,946,660

[45] Mar. 30, 1976

[54] PROCESS FOR UTILISING STRAW

[76] Inventor: Franz Kuhtreiber, Marktplatz 26a, A2136 Laa an der Thaya, Austria

[22] Filed: Nov. 12, 1974

[21] Appl. No.: 523,194

[52] U.S. Cl. ..... 100/39; 100/74; 100/DIG. 5; 100/DIG. 9; 44/1 R; 44/10 A; 44/25

[51] Int. Cl.[2]... B30B 13/00; C10L 5/00; C10L 5/16

[58] Field of Search ..... 100/70, 71, 73, 74, 75, 100/90, 35, 39, DIG. 3–DIG. 9; 44/1 R, 1 D, 10 A, 25, 27

[56] References Cited

UNITED STATES PATENTS

| | | | |
|---|---|---|---|
| 621,802 | 3/1899 | Dickson | 100/DIG. 5 |
| 692,605 | 2/1902 | Bratton | 100/74 UX |
| 896,427 | 8/1908 | Abbott | 100/DIG. 5 |
| 1,443,618 | 1/1923 | Davies | 44/25 |
| 1,572,629 | 2/1926 | Welton | 100/DIG. 3 |
| 2,170,326 | 8/1939 | Headland | 44/10 A |
| 2,270,288 | 1/1942 | Goss | 44/10 A |
| 2,296,516 | 9/1942 | Goss | 100/74 |
| 3,013,880 | 12/1961 | King | 100/DIG. 9 |

FOREIGN PATENTS OR APPLICATIONS

| | | | |
|---|---|---|---|
| 16,908 | 8/1903 | United Kingdom | 44/25 |
| 22,958 | 10/1912 | United Kingdom | 44/10.01 |

*Primary Examiner*—Peter Feldman
*Attorney, Agent, or Firm*—Allison C. Collard

[57] ABSTRACT

A process for economically utilising straw in which the straw is compressed into briquettes having a density of at least 500 kg/m$^3$, preferably at least 1000 kg/cm$^3$, for subsequent use in a thermal, chemical or microbiological plant.

2 Claims, No Drawings

PROCESS FOR UTILISING STRAW

This invention relates to a process for utilizing straw.

As agricultural operations become divided to a continuously increasing extent into cattle rearing and cereal cultivation, and stables which require no bedding are becoming increasingly used, the amount of unutilisable straw is steadily increasing. Various ways have already been considered of using the straw, but none of the previous proposals have been fully satisfactory. The possibility of its use as fodder is quantitatively limited, its use as a fertilizer would require costly processing of the straw since when the straw is distributed in the earth it decomposes too slowly and the danger of formation of isolated straw layers in the earth exists, and its use in producing industrial products such as building materials involves technical difficulties and is often uneconomical.

For these reasons straw is now mostly burnt in the field, because the collection and transportation of straw bales is uneconomical because of the time and labour involved, and because of the large volume of the bales and the consequent size of the necessary storage space. However, the burning of straw in the field causes not only considerable danger to the surroundings but also pollution of the environment due to the burnt gases and residues, and in addition valuable earth bacteria and useful small wild life such as game maybe destroyed because of such fires. Moreover the smoke from such fires maybe a nuisance, and may for example cause traffic accidents due to obstruction of view by the smoke.

However, in addition economically significant heat quantities are lost. The use of straw as an energy source on account of its high calorific value, which is of the order of 4,000 kcal, would be very desirable, but such use suffers from the same difficulties as the use of straw for industrial purposes. The usual units in which straw is produced and transported are too voluminous and unmanageable, and they need to be stacked in order to save space in storage or transport, and the handling of such units requires an uneconomical expenditure of labour, time and equipment. The thermal use of straw bales would also require a special costly combustion plant.

An object of the present invention is to provide a process for economically utilizing straw by which the aforementioned disadvantages and difficulties are avoided and which can be carried out with comparatively simple readily-available equipment.

The present invention provides a process for utilizing straw comprising compressing the straw into briquettes having a density of at least 500 kg/m$^3$, preferably at least 1,000 kg/m$^3$, for subsequent use in a desired process. The briquettes may be fed to a thermal and/or chemical and/or microbiological plant, for example for use in firing, or in the production of cellulose, albumen or alcohol.

The straw, in the form of such highly compressed briquettes, which may be handled as loose lump material, may be rationally supplied to the desired utilisation and processing facility, e.g. to a thermal power station or a chemical factory. The briquettes may be transported by any suitable means for conveying loose material, for example containers, cars and conveyors.

In producing the briquettes extensive destruction of the blades of the straw takes place and because of the exceptionally low air content of the briquettes they may be considered as a homogeneous material, or even to a certain extent as pure straw, and are accordingly much more suitable for utilisation than straw pressed into bales even if such bales are highly compressed. Due to the extensive destruction of the blades of the straw in the briquettes, the briquettes may either before or during their utilisation be divided or disintegrated without difficulty, e.g. crumbled, pulverised or ground, and in the latter case further handled as granuled or pulverised loose material.

No limits are imposed on the possible thermal, industrial, chemical or microbiological utilisation of such a homogeneous, compact, lump granular or ground straw briquette. It is however essential that the briquettes have a very high briquette density. Although a density of 500 kg/m$^3$ is sufficient for most uses, it is expedient because of smaller space requirements to produce briquettes with a density of at least 1,000 kg/m$^3$. Suitable high pressure presses are readily available for such compression and are already used for producing hay and straw briquettes intended for fodder, i.e., for feeding domestic animals. To this end, the straw is digested with soda lye and/or mixed with molasses before pressing. Such briquettes have not previously been considered for thermal or industrial utilisation.

It is particularly expedient to at least partially extract the air contained in the straw to be pressed, before and/or during the pressing operation. When pressing the straw to the above-mentioned minimum density, the accompanying pressing of too much air contained in the straw should be avoided, because the compressing or accompanying air considerably lowers the strength of the produced briquettes, and under certain circumstances the briquettes can be shattered after their production by expansion. This can be prevented only by very high pressing pressure, which causes such a compression of the straw that the expansion of the air contained in the briquettes is prevented.

On the other hand, if the air content is largely extracted from the straw before or during pressing, briquettes can be produced having a density approaching the specific gravity of pure air-free straw.

Air extraction may be carried out by various methods, whether the air contained in the straw is extracted by suction or by pressure. This suction or pressure extraction of the air may be carried out either before the actual pressing operation or advantageously simultaneously with the pressing operation.

It is also found to be extremely advantageous to treat the straw before pressing with one or more liquids, which because of their low surface tension have good wetting capacity for straw, and/or which because of their electrical conductivity reduce the static electricity charge on the straw and/or improve adhesion of the straw. Suitable aqueous or non-aqueous liquids, and also bitumen or oil based emulsions, may be used for this purpose. For this reason it is found to be expedient to wet the straw with a liquid as described above because water alone has relatively little effect because of its poor wetting capacity. The use of proper wetting agents, e.g. surface active agents, detergents and electrolytes, which are chemical compounds which dissociate in aqueous solutions, is therefore recommended. The adhesion capacity increased in this manner allows the straw on pressing to come into intimate contact and thus leads to exceptionally favourable air extraction. The better the adhesion of the straw, the less can air remain between the straw during manufacture of the briquettes. To effect air extraction, presses may be used which are fitted with at least one air extraction line, opening in the pressing chamber, or presses with localised air penetration zones formed in the pressing chamber. The base, press ram or piston and/or the side walls of the pressing chamber are usually considered for such localised zones.

It has been found particularly desirable firstly to wet the straw after its size reduction and then to pre-compress at comparatively low pressure. Through such a pre-compression of the straw, the straw blades comes into the desired intimate contact which makes the straw most suitable for processing into briquettes in a high pressure press with an optimum low air content.

Completely dry straw may be processed into briquettes only with difficulty and very high energy expenditure, and the energy consumption for producing such briquettes may be considerably reduced if the surface between the straw and press chamber wall is treated with a friction-reducing liquid. Either the straw or the wall of the press may be wetted with a suitable substance for reducing friction, before or during the pressing, A lubricant, e.g. based on carbon, hydrocarbon or synthetically based, for example graphite, a mineral oil, an organic oil, a tar oil or silicon, may be optionally added to the the straw either before or during the pressing in addition to the use of such a friction-reducing liquid. The addition of such a lubricant may be conveniently combined with the addition of an adhesion increasing liquid, a wetting agent or the like. The wetting agents and lubricants in practice may be identical.

By adding such a lubricant, the power required for pressing the straw is reduced to a minimum. All mineral and organic oils are especially useful as lubricants, and such substances are also the easiest for feeding to the pressing chamber of a press.

A binding agent, e.g. bitumen, a synthetic resin adhesive or a glue, may be added to the straw either before or during the pressing for solidifying and improving the shape stability of the briquettes, as for example is done in the production of coal briquettes. Such binding agents may in practice also function as lubricants.

The storage stability of the straw briquettes may be improved by adding a moisture repellent, e.g. an impregnating compound based on a hydrocarbon or on a synthetic resin, to the straw before or during the pressing. Such impregnated briquettes are rot proof and may be stored in the open or in damp spaces. Similarly a decay prevention agent, e.g. a disinfectant, may be added to the straw briquettes either before or during the pressing.

If the straw briquettes are intended for a chemical or microbiological use, a substance which favours or at least is not detrimental to the intended use of the briquettes may be added either before or during the pressing, e.g. a catalyst for producing chemical products from the briquettes, or a substance inert to the chemical or microbiological utilisation of the briquette which may later form a component of the product obtained from utilising the briquette.

A liquid may be added by any desired method which gives good mixing of the liquid with the straw. Advantageously, the liquid added to the straw contains additives in the form of an emuslion, a dispersion, a solution or a colloidal solution. These additives may however, be first mixed dry with the straw and then a liquid added, in which the additives become suspended, dispersed or dissolved.

The results described below illustrate the advantages of adding a liquid or such additives.

Disregarding the no-load losses of a straw pressing plant, at an output of approximately 140 kg/h of straw briquettes with the addition only of water as added liquid, the measured current consumption was 24–25 A. When from 0.4 to 0.5 percent by volume of a wetting agent, e.g. a surface active agent, was added to the water, the current consumption dropped to approximately 14 A. When, however, approximately 0.15 percent by volume of a wetting agent plus approximately 1 percent by volume of oil or bitumen were added to the water, the current consumption dropped to 7–8 A.

Although it is advantageous to add the liquid to the straw before the compression, in order to facilitate the processing of the straw and production of the briquettes, there may be subsequently carried out a water repellent treatment or treatment to improve the storage stability of the briquettes (e.g. protection against rotting or swelling), by spraying or immersing or impregnating the finished briquettes, possibly as an additional operation. Impregnation substances based on hydrocarbons, e;g. tar oil, are especially suitable for such after-treatment of the finished briquettes.

The straw to be pressed should be reduced, at least before the last pressing operation which determines the final density, into adaptable portions which are neither bulky nor unduly elongate, but which join together well in the briquettes, so that the straw already has its highest possible bulk density before passing.

An extensive destruction of the straw structure takes place as a result of the high pressure used for the final compression, additional to the previous reduction in size of the straw blades before pressing. The briquettes obtained by high compression of the straw may be reduced in size before or during their utilisation into a for example granular or powdered material. The briquettes are then fed in granular or powder form, preferably dispersed in a gas or liquid, for their utilisation or further processing. The straw briquettes may thereby be reduced in size to particles of basically any desired size, according to the intended purpose for which the particles are to be used, such as grinding the briquettes for firing as powdered fuel or suspending the particles in a reaction liquid.

The granular or pulverised straw may also be mixed or used mixed with materials which are of assistance to its thermal or chemical-microbiological use, such as in the case of thermal use, with other combustion materials, or, in the case of chemical use, with substances which are components or catalysts for the actual chemical raw material to be produced. In the case of microbiological utilisation of the straw, the mixed mass with the granular or pulverised straw may for example be used as the secondary component or basic substance of a suitable nutrient medium for the small organisms to be used.

The extent of the compression is determined in relation to technical and economical considerations, and consequently the optimum extent is determined by taking into consideration the cost of the portable and/or stationary straw presses and the transport costs for the pelletised straw units. the extent of the precompression may be chosen to be any desired fraction, for example, one half, of the final density.

The straw to be utilised which is still in the field is suitably firstly cut with a harvester thresher, is threshed and then distributed on the cut field. This distributed straw is received, reduced in size and compressed into briquette-like blocks having a bulk density of from 200 to 300 kg/m$^3$ by means of known portable machines previously used only for briquetting hay. During this operation the straw may also be subjected to air removal and/or reduction in the skin friction in the compression cylinder and/or improvement in adhesion by wetting and/or reduction in the electrostatic charge on the straw particles.

These briquette-like blocks, still of comparatively low density, are then fed to presses which permit the predetermined final density to be obtained. These presses may be stationary or, at least between the individual pressing stages, transportable. In the latter case a stationary press is, however, recommended at least during the compression process.

Before the final compression into briquettes having a bulk density of from 500 to 1,000 kg/m$^3$ or more, the blocks are reduced in size, wetted with a liquid as described above, subjected if required to compression in order to remove air, and finally compressed to the final bulk density.

If subjected to water repellent treatment, these briquettes may be stored in the open air and supplied at any required time for their desired use, e.g. burning in a furnace. If no water repellent treatment is provided, it is recommended that the briquettes are stored under a lean-to-roof. By adding a suitable liquid, the briquettes may be fed to a enzymatic or acid hydrolysis cellulose production process, by which the cellulose is decomposed to d-glucose, which as such may be used for example as fodder or may be converted by adding suitable microorganisms to proteins or other products, e.g. ethyl alchohol.

I claim:

1. A process for utilizing straw comprising the steps of grinding dry straw to produce ground dry straw particles;

wetting the ground dry straw particles with a liquid containing additives for lowering the surface tension, increasing electrical conductivity and improving the cohesion thereof;

pre-pressing the wetted, ground straw particles to substantially rework the air contained therebetween by pressing the elastic straw particles tightly against one another, whereby the straw particles remain tightly against one another due to the lowered surface tension, the increased electrical conductivity and the improved cohesion; and final pressing of the substantially air freed straw particles by application of a high pressure to produce bulk density of at least 500 kg/m3.

2. The process as claimed in claim 1 whereby said bulk density is over 1000 kg/m3.

* * * * *